US006883531B1

(12) United States Patent
Perttu

(10) Patent No.: US 6,883,531 B1
(45) Date of Patent: Apr. 26, 2005

(54) TIP-UP TENT

(76) Inventor: Brian H. Perttu, 4111 US 45 N., Bruce Crossing, MI (US) 49912

( * ) Notice: Subject to any disclaimer, the term of this patent is extended or adjusted under 35 U.S.C. 154(b) by 0 days.

(21) Appl. No.: 10/342,463

(22) Filed: Jan. 14, 2003

(51) Int. Cl.[7] ..... E04H 15/48

(52) U.S. Cl. ..... 135/151; 135/115; 135/118; 135/126

(58) Field of Search ..... 135/900, 901, 135/902, 126, 151, 152, 153, 154, 155, 156, 135/115, 118, 119

(56) References Cited

U.S. PATENT DOCUMENTS 1,784,199 A * 12/1930 Peterson ..... 135/144
3,699,986 A * 10/1972 Kirkham ..... 135/97
3,812,616 A * 5/1974 Koziol ..... 52/63
3,847,170 A * 11/1974 Anderson ..... 135/95
3,896,831 A * 7/1975 Feldman et al. ..... 135/142
3,957,069 A * 5/1976 Denaro ..... 135/118
3,970,096 A * 7/1976 Nicolai ..... 135/94
4,067,346 A * 1/1978 Husted ..... 135/153
4,237,914 A * 12/1980 Gantz ..... 52/2.19
4,285,354 A * 8/1981 Beavers ..... 135/135
4,320,744 A * 3/1982 Fodor et al. ..... 126/570
4,408,260 A * 10/1983 Miedel ..... 362/576
5,333,634 A * 8/1994 Taylor ..... 135/98
5,368,057 A * 11/1994 Lubkeman et al. ..... 135/133
5,582,197 A * 12/1996 Dobberstein ..... 135/87
6,213,138 B1 * 4/2001 Wimpee ..... 135/121
6,604,537 B1 * 8/2003 Zheng ..... 135/126

* cited by examiner

*Primary Examiner*—Korie Chan
*Assistant Examiner*—Kofi Schulterbrandt

(57) ABSTRACT

A tip-up tent is provided, comprising a foldable tubular A-frame comprising four diagonal legs connected to a horizontal member, a hinged transparent flexible cover supported by the A-frame with each side of the cover having a lower flap with holes in each lower corner, and a plurality of arrow-shaped stakes, wherein the tip-up tent is held in place on ice by stakes driven into the ice through the holes or by snow piled up on the flaps. The tip-up tent has particular utility in connection with protecting an ice fishing tip-up from the wind and snow.

18 Claims, 3 Drawing Sheets

TIP-UP TENT

BACKGROUND OF THE INVENTION

1. Field of the Invention

The present invention relates to a tip-up tent for use in connection with ice fishing. The tip-up tent has particular utility in connection with protecting an ice fishing tip-up from wind and snow.

2. Description of the Prior Art

Tip-up tents are desirable for protecting ice fishing tip-ups from the wind and snow.

The use of an apparatus to facilitate ice fishing is known in the prior art. For example, U.S. Pat. No. 4,845,878 to Hackel discloses an ice fishing hole cover and tip-up. However, the Hackel '878 patent does not provide for keeping snow out of the hole.

U.S. Pat. No. 4,787,166 to Vogt et al. discloses a collapsible enclosed fisherman's signaling device. However, the Vogt '166 patent does not provide visibility of the apparatus when it is snowing.

U.S. Pat. No. 5,598,656 to Strasser discloses an insulated tip-up. However, the Strasser '656 patent does not provide visibility of the fishing device, and cannot provide convenient portability for numerous units.

U.S. Pat. No. 4,662,099 to Stewart discloses an ice-free tip up system. However, the Stewart '099 patent does not provide visibility of the fishing device, and additionally does not provide convenient portability for numerous units.

U.S. Pat. No. 4,953,317 to Ruchel discloses a nonfreezing fishing apparatus. However, the Ruchel '317 patent does not provide convenient portability for numerous units.

Lastly, U.S. Pat. No. Des. 425,958 to DePasquale discloses a portable tent. However, the DePasquale '958 patent does not provide protection from the snow and wind in all directions, and has the additional deficiency of insufficient attachments to ice for stability, making it unsuitable for use as a tip-up tent.

While the above-described devices fulfill their respective, particular objectives and requirements, the aforementioned patents do not describe a tip-up tent that allows easy portability and sufficient protection for an ice fishing tip-up from wind and snow. The prior art patents make no provision for easy portability, visibility, and convenient use when it is snowing.

Therefore, a need exists for a new and improved tip-up tent that has easy portability and can be used for protecting an ice fishing tip-up from wind and snow. In this regard, the present invention substantially fulfills this need. In this respect, the tip-up tent according to the present invention substantially departs from the conventional concepts and designs of the prior art, and in doing so provides an apparatus primarily developed for the purpose of protecting an ice fishing tip-up from wind and snow.

SUMMARY OF THE INVENTION

In view of the foregoing disadvantages inherent in the known types of ice fishing apparatus now present in the prior art, the present invention provides an improved tip-up tent, and overcomes the above-mentioned disadvantages and drawbacks of the prior art. As such, the general purpose of the present invention, which will be described subsequently in greater detail, is to provide a new and improved tip-up tent which has all the advantages of the prior art mentioned heretofore and many novel features that result in a tip-up tent which is not anticipated, rendered obvious, suggested, or even implied by the prior art, either alone or in any combination thereof.

To attain this, the present invention essentially comprises a tip-up tent, comprising a frame with four diagonal legs connected to a horizontal member, a cover supported by the frame, the cover comprising a front section, a rear section, a right side section, and a left side section, each section comprising a lower flap having two lower corners with each lower corner defining a hole therein, an attachment connecting the front section and the rear section, and a plurality of stakes.

In one embodiment, the present invention comprises a tip-up tent, comprising a frame with four diagonal legs connected to a horizontal member, a transparent flexible cover supported by the frame, the cover comprising a front section, a rear section, a right side section, and a left side section, each section comprising a lower flap having two lower corners with each lower corner defining a hole therein, an attachment connecting the front section and the rear section, and a plurality of arrow-shaped stakes.

In another embodiment, the present invention comprises a tip-up tent, comprising a foldable tubular A-frame with four diagonal legs connected to a horizontal member, a transparent flexible cover supported by the A-frame, the cover comprising a front section, a rear section, a right side section, and a left side section, each section comprising a lower flap having two lower corners with each lower corner defining a hole therein, a first hinge and a second hinge, the hinges connecting the front section and the rear section, and a plurality of arrow-shaped stakes, wherein the tip-up tent is held in place on ice by the stakes that are driven into the ice through the holes.

There has thus been outlined, rather broadly, the more important features of the invention in order that the detailed description thereof that follows may be better understood and in order that the present contribution to the art may be better appreciated.

The invention may also include a tip-up and other attachments. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tip-up tent that has all of the advantages of the prior art ice fishing apparatuses and none of the disadvantages.

It is another object of the present invention to provide a new and improved tip-up tent that may be easily and efficiently manufactured and marketed.

An even further object of the present invention is to provide a new and improved tip-up tent that has a low cost of manufacture with regard to both materials and labor, and which accordingly is then susceptible of low prices of sale to the consuming public, thereby making such tip-up tent economically available to the buying public.

Still another object of the present invention is to provide a new tip-up tent that provides in the apparatuses and methods of the prior art some of the advantages thereof, while simultaneously overcoming some of the disadvantages normally associated therewith.

Even still another object of the present invention is to provide a tip-up tent for protecting an ice fishing tip-up from the wind. This allows a flag to signal when a fish has been caught, instead of also being signaled by the wind.

Still yet another object of the present invention is to provide a tip-up tent for protecting an ice fishing tip-up from snow. This allows snow to be kept out of the hole to prevent the build-up of slush.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
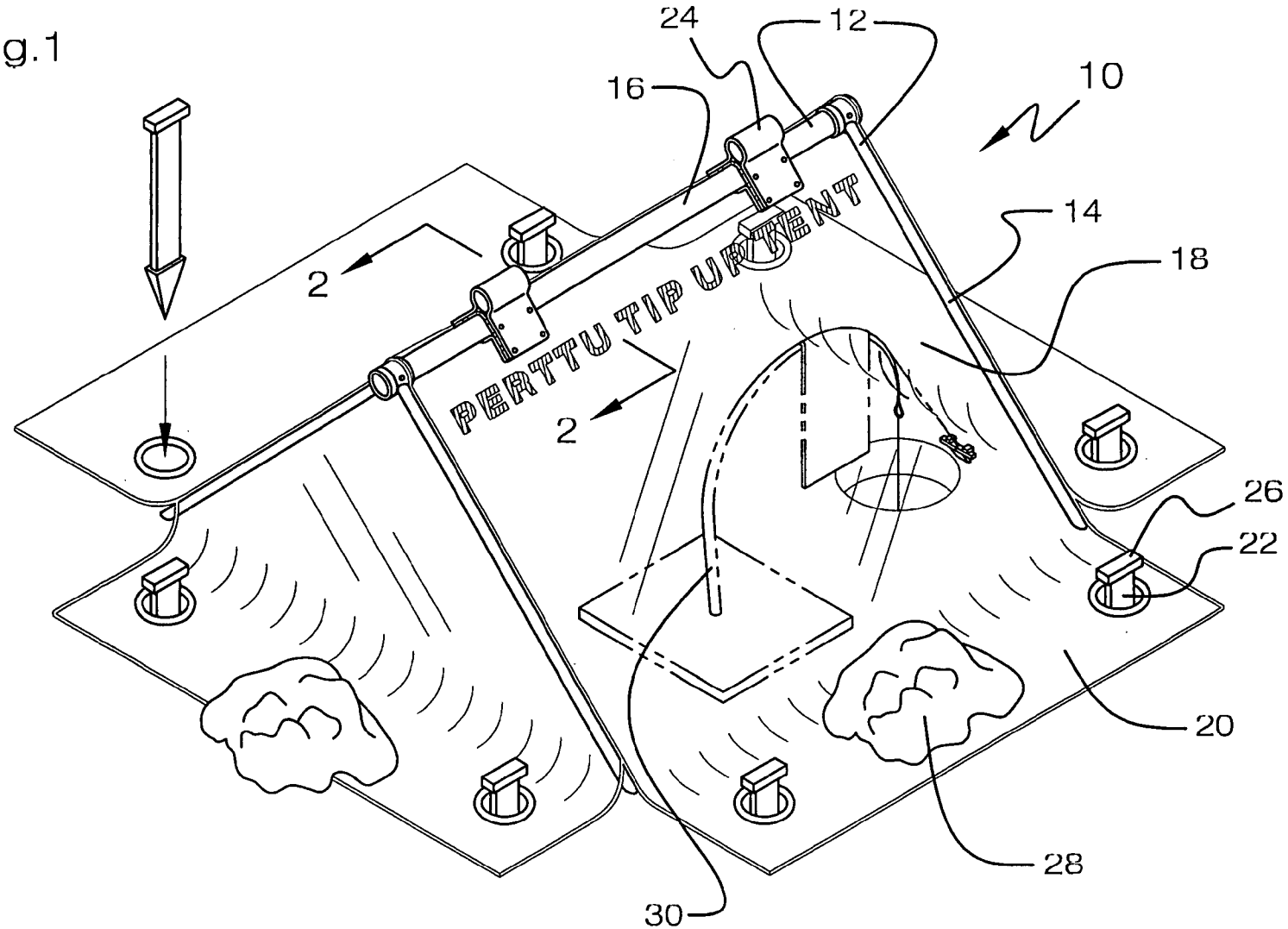
FIG. 1 is an isometric perspective view of the preferred embodiment of the tip-up tent constructed in accordance with the principles of the present invention.
Figure 2:
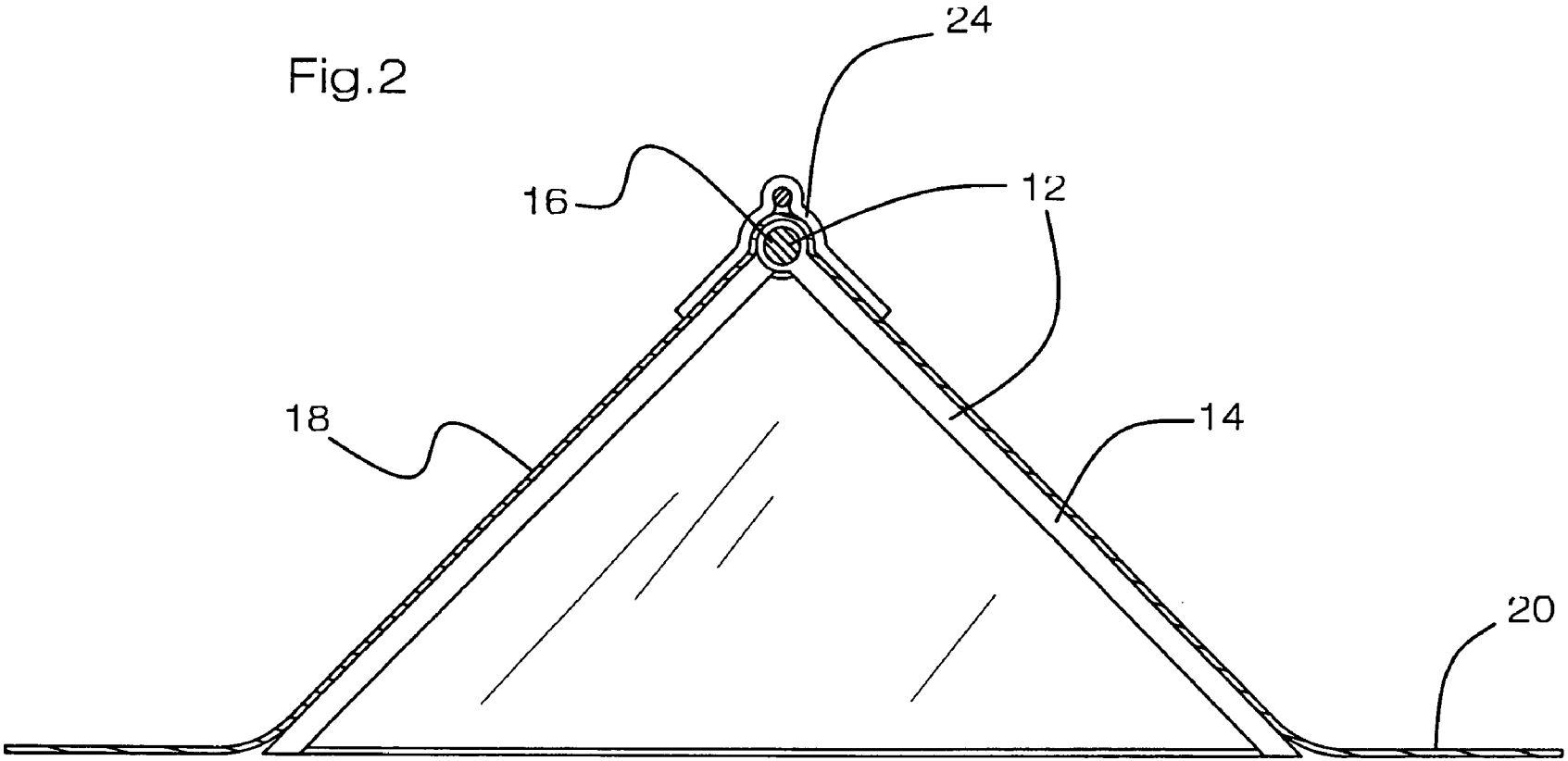
FIG. 2 is a right elevational cross-sectional view of the tip-up tent of the present invention illustrated in FIG. 1 and taken along the line 2—2.
Figure 3:
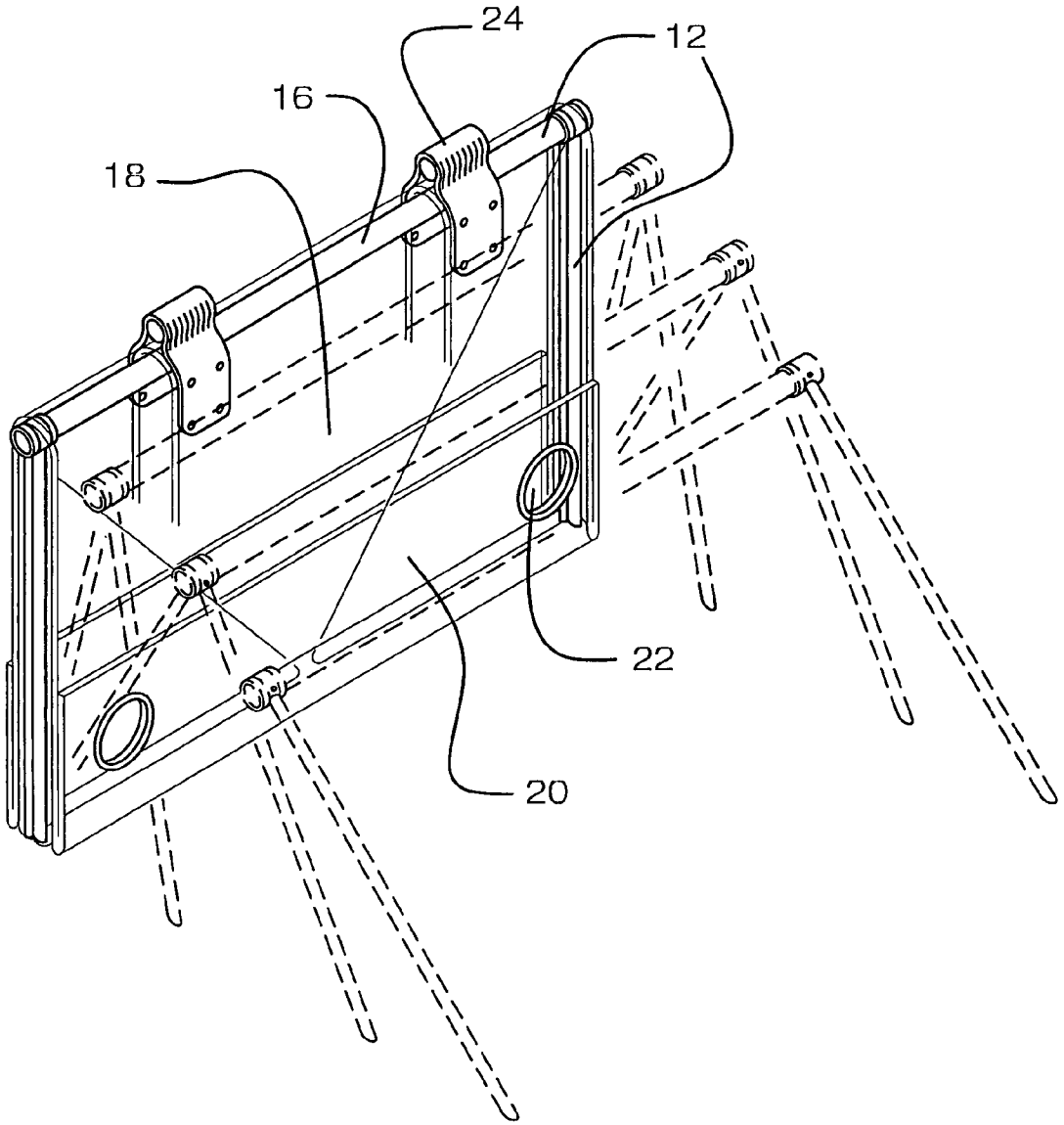
FIG. 3 is an isometric perspective view of the folded tip-up tent of the present invention.

Referring now to the drawings, and particularly to FIGS. 1–3, a preferred embodiment of the tip-up tent of the present invention is shown and generally designated by the reference numeral 10.

In FIG. 1, a new and improved tip-up tent 10 of the present invention for protecting an ice fishing tip-up 30 from the wind and snow is illustrated and will be described. More particularly, the tip-up tent 10 comprises a foldable tubular A-frame 12 comprising four diagonal legs 14 connected to a horizontal member 16, a transparent flexible cover 18 supported by the A-frame 12, the cover 18 comprising a front section, a rear section, a right side section, and a left side section, each section comprising a lower flap 20 having two lower corners with each lower corner defining a hole 22 therein, a first hinge attachment 24 and a second hinge attachment 24, the hinges 24 connecting the front section and the rear section of the cover 18, and a plurality of arrow-shaped stakes 26, wherein the tip-up tent is held in place on ice by the stakes 26 that are driven into the ice through the holes 22 or by snow 28 piled on the flaps 20, thus the tip-up tent 10 protects the tip-up 30 from wind and snow.

FIG. 2 is a right elevational cross-sectional view of the tip-up tent of the present invention, and illustrates the foldable tubular A-frame 12 comprising legs 14 connected to a horizontal member 16, a transparent flexible cover 18 supported by the A-frame 12, the cover 18 having flaps 20 along the ground and hinge attachments 24 over the horizontal member.

FIG. 3 is an isometric perspective view of the folded tip-up tent of the present invention, and illustrates the folded frame 12 comprising legs 14 connected to a horizontal member 16, a transparent flexible cover 18 with hinge attachments 24 and flaps 20 having holes 22 at the corners.

The tip-up tent of the present invention is an apparatus that has utility for protecting an ice fishing tip-up from the wind and snow. In one embodiment, the tip-up tent comprises a clear plastic tent that measures approximately 20 inches tall by approximately 20 inches long and approximately 9 to 10 inches wide. The tent is supported by a folding frame that preferably comprises aluminum or fiberglass tubing. The tent is held in place by stakes that are driven into the ice through a hole in each corner, or the user can simply pile snow up on flaps that extend around the perimeter.

The tubing and stakes may comprise any metal or plastic material, and they may be painted or otherwise decorated. Suitable metals include aluminum, steel, and stainless steel. Suitable plastics include rigid molded poly(vinyl chloride) (PVC), polypropylene (PP), a polyethylene (PE) such as high density polyethylene (HDPE), an acrylonitrile-butadiene-styrene (ABS) resin, a styrene-acrylonitrile (SAN) resin, or blends thereof, as well as nylon or any other suitable plastic material known to those skilled in the art. Suitable transparent plastic tent materials include transparent flexible poly(vinyl chloride) (PVC), a polyester such as polyethylene terephthalate (PET), and the like.

The tip-up tent of the present invention fulfills the need for a product that prevents the wind from releasing a tip-up or filling a hole in the ice with snow. The appealing features of the tip-up tent include its convenience, time saving nature, and ease of use. A large number of ice fishermen like to use several tip-ups. The tip-up tent makes a tip-up easier to use in windy or snowy weather by protecting the tip-up from the elements. In use, an ice fisherman simply sets a tip-up in the conventional manner and then places the tip-up tent over the tip-up. The tent prevents the wind from releasing the flag or blowing snow into the hole. This allows the tip-up to remain set and release its flag only when a fish grabs the bait. As a result, the fisherman has fewer false alarms and does not need to rush over to the hole as is typically done when wind releases the flag. The tip-up tent also keeps snow out of the hole so that the hole remains clear and there is less need to scoop out slush.

In one embodiment, the tip-up tent of the present invention features clear plastic walls that allow the fisherman to see the tip-up from any angle. This makes it quick and easy to see when a fish strikes. The tip-up tent of the present invention also works well at night since it is easy to see the tip-up through the walls of the tent. When the tip-up tent is not in use, its lightweight nature and compact design make it easy to carry, transport, or store. This allows a fisherman to purchase a tent for each of his tip-ups and take them along on each fishing trip. The frame folds up to make each tent easy to handle, and the plastic walls are weather resistant and durable so that the tent lasts several years.

In one embodiment, the tip-up tent of the present invention comprises a temporary enclosure for use with a fishing tip-up apparatus, whereby the present invention includes a collapsible elongated triangular framework featuring deployable stakes integrally associated with each corner for engaging a supporting ice surface, such that the elongated framework members further include unique free folding hinge elements for providing extremely compact storage.

In use, it can now be understood that the tip-up tent of the present invention has particular utility in connection with easy portability and with protecting an ice fishing tip-up from the wind and snow.

While a preferred embodiment of the tip-up tent has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, composite material, or a variety of wood may be used instead of the aluminum or fiberglass tubing described. Also, the stakes may be made of heavy-duty plastic, wood, metal, or similar material. And although protecting an ice fishing tip-up from the wind and snow has been described, it should be appreciated that the tip-up tent herein described is also suitable for camping and for protecting any person or object from the elements. Furthermore, a wide variety of attachments may be used instead of the hinges described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tip-up tent, comprising:

a frame comprising four diagonal legs connected to a horizontal member;

a cover supported by said frame, said cover comprising a front section, a rear section, a right side section, and a left side section, each said section comprising a lower flap having two lower corners, each said lower corner defining a hole therein;

a hinge having opposing ends with one end connected to said front section of said cover and said opposing end connected to said rear section of said cover; and a plurality of stakes.

2. The tip-up tent of claim 1, wherein said cover is flexible and transparent.

3. The tip-up tent of claim 1, wherein said stakes are arrow-shaped.

4. The tip-up tent of claim 1, wherein said diagonal legs and said horizontal member are tubular.

5. The tip-up tent of claim 1, wherein said tip-up tent is foldable.

6. The tip-up tent of claim 1, wherein said tip-up tent is held in place on ice by said stakes that are driven into the ice through said holes.

7. The tip-up tent of claim 1, wherein said tip-up tent is held in place by snow piled up on said flaps.

8. A tip-up tent, comprising:

a frame comprising four diagonal legs connected to a horizontal member;

a transparent flexible cover supported by said frame, said cover comprising a front section, a rear section, a right side section, and a left side section, each said section comprising a lower flap having two lower corners, each said lower corner defining a hole therein;

a hinge having opposing ends with one end connected to said front section of said cover and said opposing end connected to said rear section of said cover; and a plurality of arrow-shaped stakes.

9. The tip-up tent of claim 8, wherein said diagonal legs and horizontal member are tubular.

10. The tip-up tent of claim 8, wherein said tip-up tent is foldable.

11. The tip-up tent of claim 8, wherein said tip-up tent is held in place on ice by said stakes that are driven into the ice through said holes.

12. The tip-up tent of claim 8, wherein said tip-up tent is held in place by snow piled up on said flaps.

13. A tip-up tent, comprising:

a foldable tubular A-frame comprising four diagonal legs connected to a horizontal member;

a transparent flexible cover supported by said A-frame, said cover comprising a front section, a rear section, a right side section, and a left side section, each said section comprising a lower flap having two lower corners, each said lower corner defining a hole therein;

a first hinge having opposing ends and a second hinge having opposing ends said hinges having one end connected to said front section of said cover and said opposing end connected to said rear section of said cover; and a plurality of arrow-shaped stakes;

wherein said tip-up tent is held in place on ice by said stakes that are driven into the ice through said holes.

14. The tip-up tent of claim 13, wherein said A-frame comprises aluminum tubing.

15. The tip-up tent of claim 13, wherein said A-frame comprises fiberglass tubing.

16. The tip-up tent of claim 13, wherein said tip-up tent is held in place by snow piled up on said flaps.

17. The tip-up tent of claim 13, wherein said transparent flexible cover comprises a plastic material.

18. The tip-up tent of claim 13, further comprising a tip-up.

* * * * *